United States Patent [19]

Monforte

[11] Patent Number: 4,723,774

[45] Date of Patent: Feb. 9, 1988

[54] EXERCISE MACHINE

[75] Inventor: Pedro L. Monforte, Barcelona, Spain

[73] Assignee: Maquina Sports, S.A., Barcelona, Spain

[21] Appl. No.: 693,853

[22] Filed: Jan. 23, 1985

[30] Foreign Application Priority Data

| | | | |
|---|---|---|---|
| Mar. 7, 1984 | [ES] | Spain | 278007[U] |
| Mar. 7, 1984 | [ES] | Spain | 278008[U] |
| Jul. 31, 1984 | [ES] | Spain | 280784[U] |
| Nov. 20, 1984 | [ES] | Spain | 282690[U] |
| Nov. 20, 1984 | [ES] | Spain | 282691[U] |

[51] Int. Cl.[4] ..... A63B 69/06

[52] U.S. Cl. ..... 272/72; 272/130

[58] Field of Search ..... 272/72, 93, 96, 97, 272/130, 145

[56] References Cited

U.S. PATENT DOCUMENTS

| | | | |
|---|---|---|---|
| 1,752,901 | 4/1930 | Falkenburg | 272/72 |
| 1,950,896 | 3/1934 | Luzzi | 272/72 |
| 2,251,120 | 7/1941 | Davis | 272/72 |
| 4,477,071 | 10/1984 | Brown et al. | 272/72 |

FOREIGN PATENT DOCUMENTS

| | | | |
|---|---|---|---|
| 657806 | 11/1963 | Italy | 272/72 |
| 383830 | 11/1932 | United Kingdom | 272/72 |
| 0895469 | 1/1982 | U.S.S.R. | 272/72 |

*Primary Examiner*—Richard J. Apley
*Assistant Examiner*—S. R. Crow
*Attorney, Agent, or Firm*—Abelman Frayne Rezac & Schwab

[57] ABSTRACT

An exercise machine has braking devices positioned directly on the frame of the machine and to which levers are attached for manipulation by the user, the levers being foldable into proximity with the frame to permit ready storage of the device, the frame being provided with an accessory bar enabling the device to be used in an upright position in addition to a prone position, a seat of the device providing for support of the device when in an upright position.

4 Claims, 30 Drawing Figures

A-B

C-D

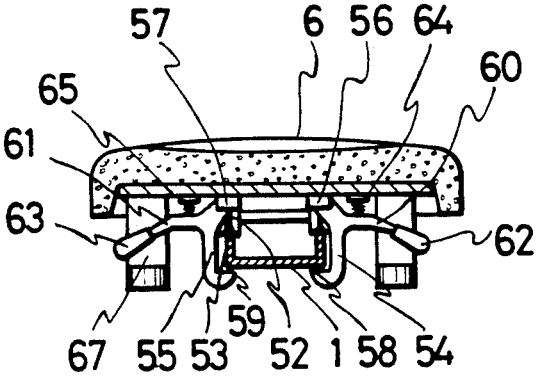
FIG.-11
FIG.-10
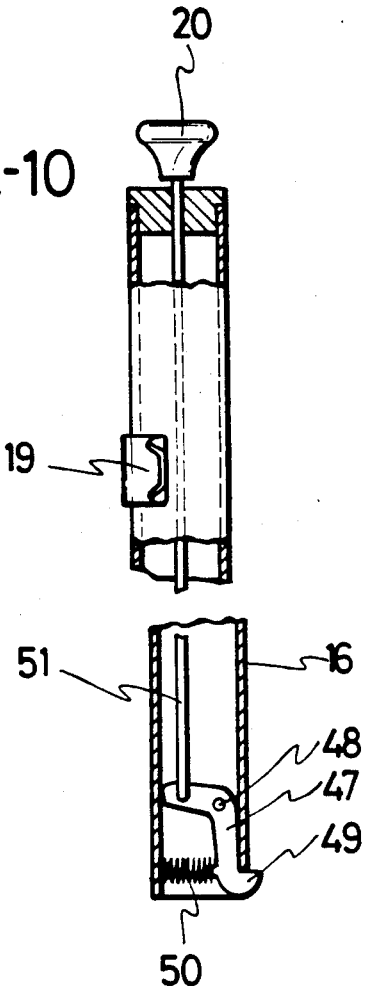

FIG.-14
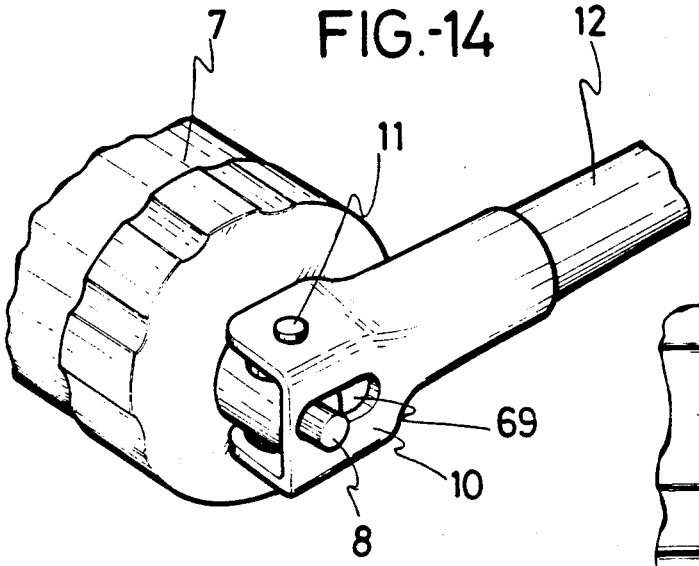
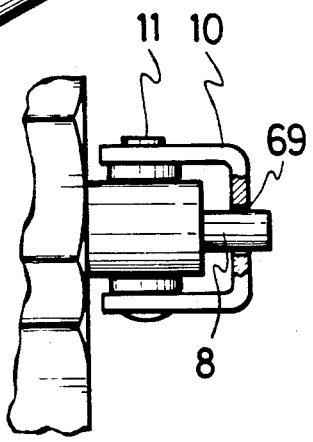
FIG.-15
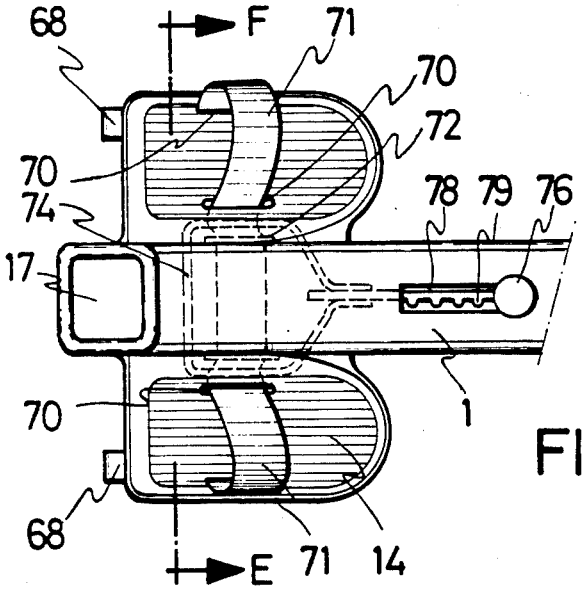
FIG.-16

E-F

EXERCISE MACHINE

FIELD OF THE INVENTION

The present invention relates to an exercise machine, which, although basically designed so that the user can practice physical exercises resembling rowing, also enables the user to practice other physical exercises.

BACKGROUND OF THE INVENTION

Devices designed for the same purpose are known. Those devices comprise a chassis mountable on the floor, a pair of lateral arms connected to the chassis, a footrest situated at one end portion of the chassis, and, a seat that can be displaced axially along the chassis. The arrangement is such that the user may rest his body on said seat, support his feet on the footrest, and use his hands to move the levers in a rowing motion. The levers act against adjustable brake devices which control the amount of physical effort required to carry out that exercise.

Basic problems presented by the conventional exercise machines reside in their functional limitations on one hand, and, their large size on the other. The latter problem is of considerable importance when the machine is designed for home use, and must be stored after use.

Known exercise machines employ adjustable brake mechanisms, hydraulic or pneumatic cylinders, or mechanical springs, which are connected between the movable levers and the frame and define two lateral triangles. Those triangles must be laterally separated, all of these structural features contributing to the large size of the exercise machine.

These structural characteristics not only lead to the above mentioned problems, but also establish functional limitations on the machine. The degree to which the arms can be oscillated determines a first limitation. A second limitation is determined by the angle through which the arms can be moved. These limitations determine the maximum degree of oscillation of said arms.

Furthermore, said brake devices, due to their disposition at an exterior of said exercise machine not only increase the dimensions of the machine, but also prevent use of the machine for certain type of physical exercises.

Another problem relates to the bands used for fastening the user's feet to the foot rest. Said bands resemble bridges in some cases fixed in length, or, in other cases adjustable by means of lateral buckles rendering the use thereof difficult.

Another problem is the lack of flexibility in adjusting the distance between the arms and the footrest.

Other gymnastic devices include an accessory ortogonally couplable to one end of the frame in order to permit vertical positioning thereof. This enables the user to practice a number of physical exercises. However, the said accessory increases the size and complexity of the machine, and makes the finished product expensive and difficult to store.

The exercise machine proposed by the present invention overcomes these problems in a satisfactory manner.

SUMMARY OF THE PRESENT INVENTION

According to one feature of the invention, the brake devices are mounted about the axis of oscillation of the levers. Thereby said levers do not relate to the frame by forming a deformable triangle, but rather form a simple angle relative thereto.

The brake devices, which can be hydraulic, pneumatic, mechanical or any other type, are formed by lateral projections of said frame. The frame is thus simplified into a suitably sized longitudinal stringer, on the surface of which a seat slides longitudinally. Stability of said stringer is ensured by supporting elements positioned on the housings of brake devices, the housing being disposed at a middle zone of said longitudinal stringer.

The brake devices can either be two separate devices, or, can be constituted by a single central brake element. Preferably, the brake devices include a radial blade designed to displace fluid through a variable restriction so that the required braking effect is obtained.

In accordance with another characteristic of the invention, the adjustable brakes are movable along the longitudinal stringer, and slide along guides on the lower edges of the frame. Setscrews contact the base of said stringer and lock said carriage at any selected position along the stringer. Thus, the user of said exercise machine can adjust in accordance with his own needs, the distance between the axis of oscillation of the actuating levers and the footrest.

A further characteristic of the invention includes an accessory employed in conjunction with the longitudinal stringer when the frame is to be used in a vertical position. The accessory is constituted by a simple bar, detachably attachable to that end of the frame where the footrest is disposed by a simple socket connection. The removable seat mounted on the frame is mountable on the bar and thus has utility not only as the abovementioned supporting platform for the user, but also as a supporting means for the assembly when it is used in a vertical position. The particular structure of the footrest also helps in providing stability to the device.

The seat includes legs on its under surface which, when said seat is coupled to the accessory bar, function as supporting legs, and, in conjunction with supporting elements disposed at the extreme ends of said footrest, provide adequate stability to the assembly.

The end supports of the footrest permit storage of said device in a vertical positon.

In this position, the operational levers remain bent against the frame itself, thus reducing the space required for storage of said frame. Said operating levers rotate up to a maximum of 180° from a horizontal position, close to floor level, to the opposite horizontal position. This increases the functionality of the present device versus known devices.

The operating levers are associated to their corresponding axes of oscillation by means which permit the levers to be moved towards or away from each other.

Finally, a further characteristic of the invention includes control means for the bands which serve to secure the user's feet to the footrest.

DESCRIPTION OF THE DRAWINGS

The invention will now be descibed with reference to the accompanying drawings, which show preferred embodiments of the invention, and in which:

FIG. 1' is an exploded perspective view of FIG. 1, showing the kit of parts as intended for sale.

FIG. 10 is a side elevation of the accessory bar, in partial cross section, and showing mechanisms employed for locking the accessory bar to the frame.

FIG. 11 is a front elevational view of the seat showing in detail the mechanisms employed for the detachable connection thereof to the frame.

FIG. 14 is a perspective view of an end zone of one of the adjustable brake mechanisms, showing means for coupling the corresponding actuating lever to said mechanism.

FIG. 15 is a front elevational view of the assembly of FIG. 14.

FIG. 16 is a partial plan view of the footrest shown in FIG. 1.

DESCRIPTION OF THE PREFERRED EMBODIMENTS

Figure 1:
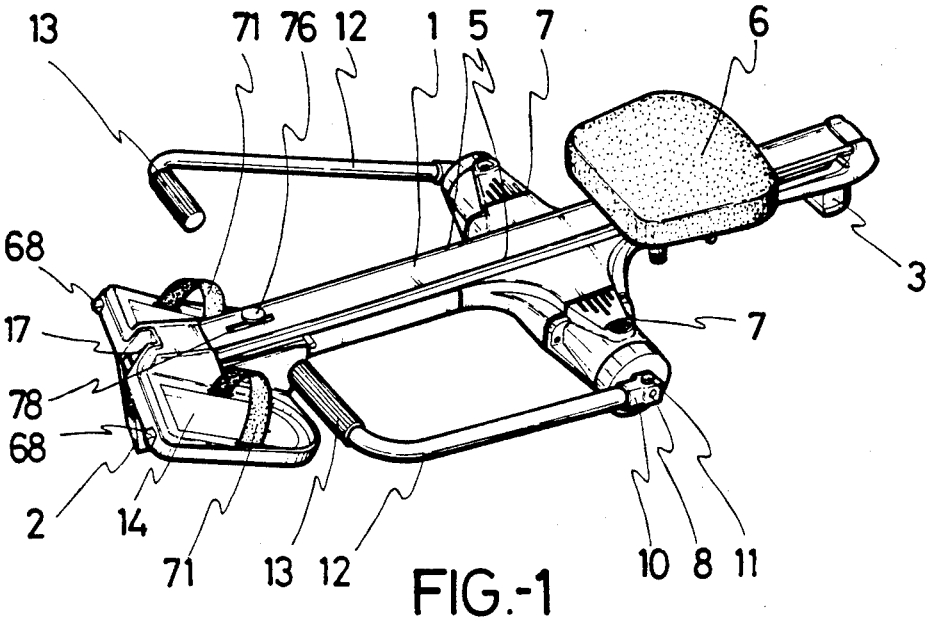
FIG. 1 is a perspective view of one form of exercise machine according to the object of the present invention.
Figure 1:
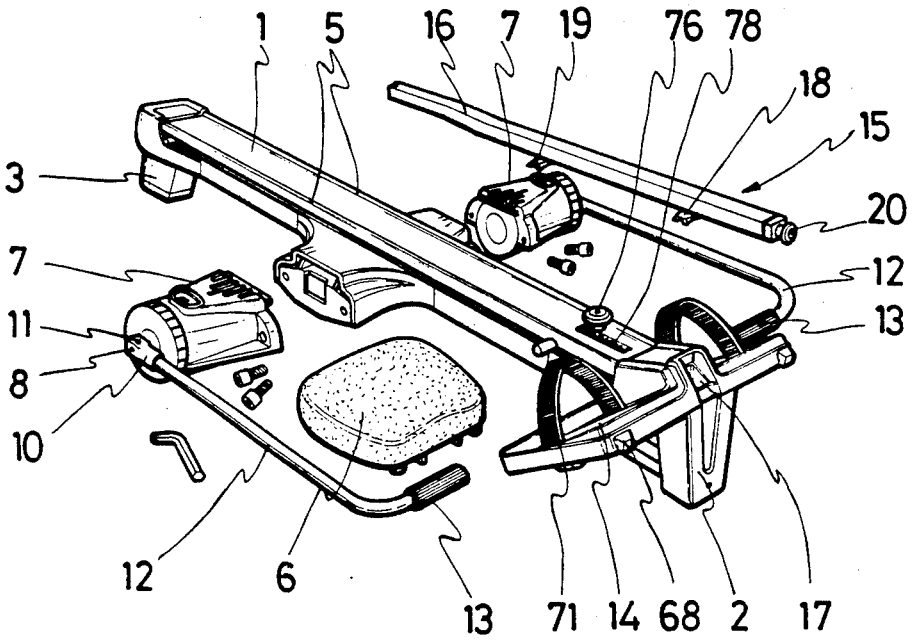
Figure 2:
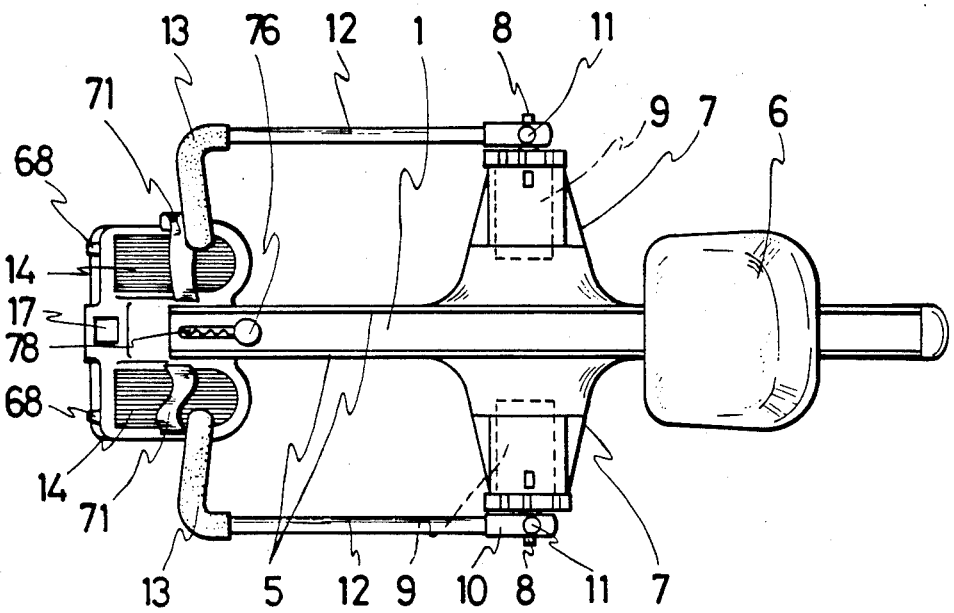
FIG. 2 is a plan view of the machine.
Figure 3:
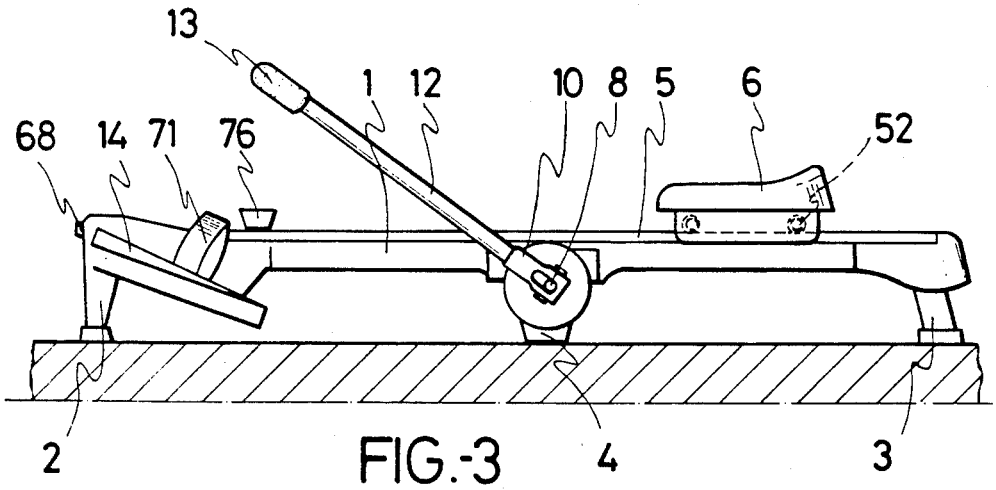
FIG. 3 is a side elevational view of the machine, shown supported on a floor, and readied for use in physical exercise.

Referring to FIGS. 1, 2 and 3, it will be seen that the exercise machine of the invention includes a frame 1 supporting feet 2 and 3 at its ends, and intermediate supports.

Two opposed symmetrical extensions 7, are mounted on the frame 1, the respective extensons 7 each carrying one of the intermediate supports 4.

The symmetrical extensions 7 each have a stub shaft 8 extending therefrom, the stub shafts 8 respectively being connected to braking devices 9 contained within the extensions 7. Ends 10, of two levers 12 are articulated on the free ends of the shafts 8 by means of pins 11. The levers 12 are provided with grips 13.

A footrest 14 having inclined foot supporting planes, one at each side of frame 1, is rigidly mounted on one end of the frame 1.

By the use of independent brake devices 9 repectively controlling the movements of one of the levers 12, the oscillating movement of the respective levers 12 may either coincide with, or be the opposite to the movement of the other lever, and also, the braking effects exerted on the respective levers may be substantially different from each other. Alternatively, a single brake device can be employed. However, this will result in a reduction of the utility of the machine, by virtue of the two actuating levers being mounted on a common shaft, the action of said levers then being simultaneous and parallel, and, the braking tension being the same for both of them.

In its basic form, the exercise machine of the invention rests on the floor. However, the practice of certain types of exercises requires that the frame 1 be arranged in a vertical position, as illustrated in FIG. 4.

Figures 4, 5:
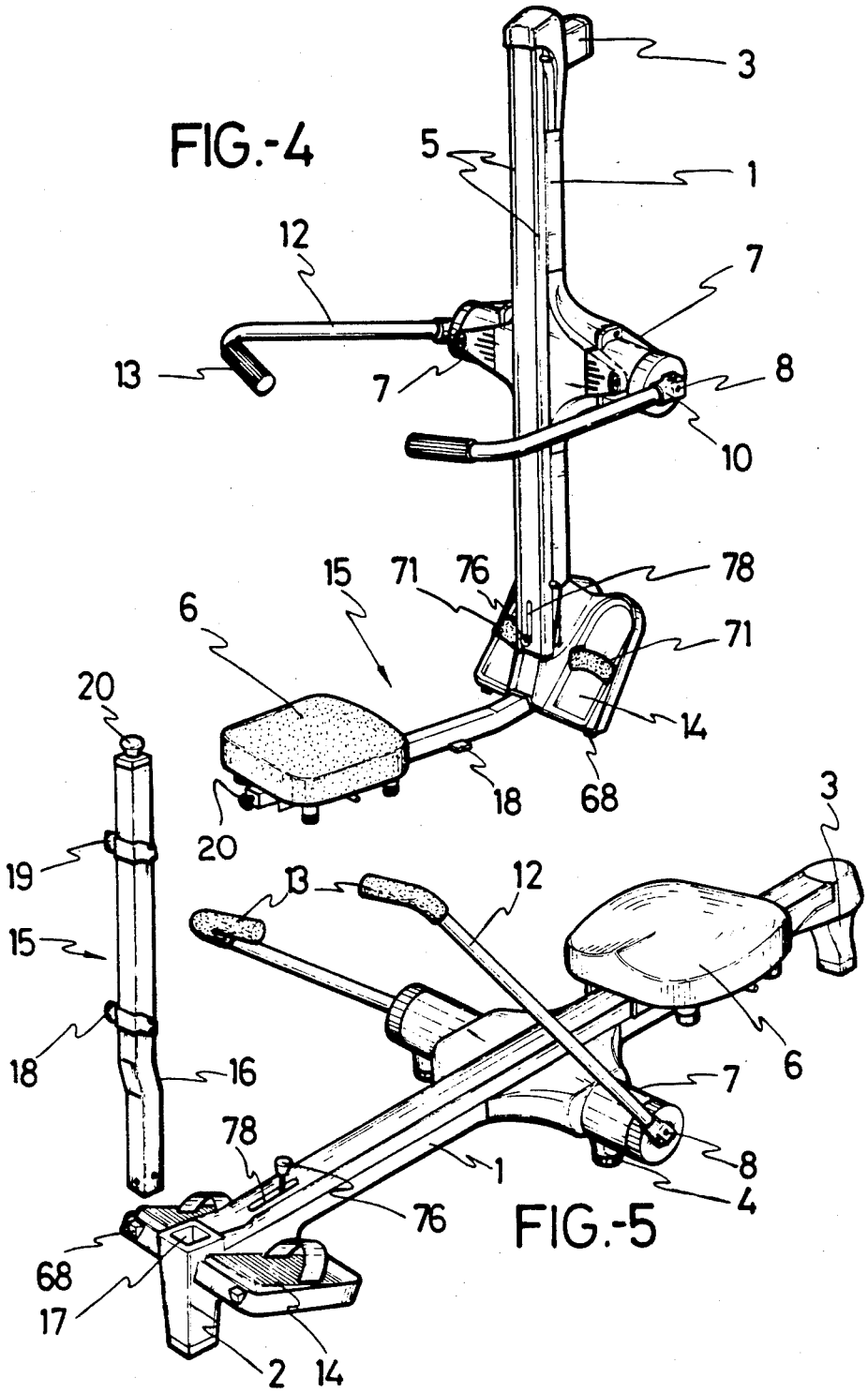
FIG. 4 is another perspective view of an alernative assemblage of the machine in which an accessory bar permits a vertical disposition of the frame, the seat having been uncoupled from said frame and connected to the accessory bar.
FIG. 5 shows the same machine of the previous Figure, at the stage of connection of the accessory bar to the frame.
Figure 6:
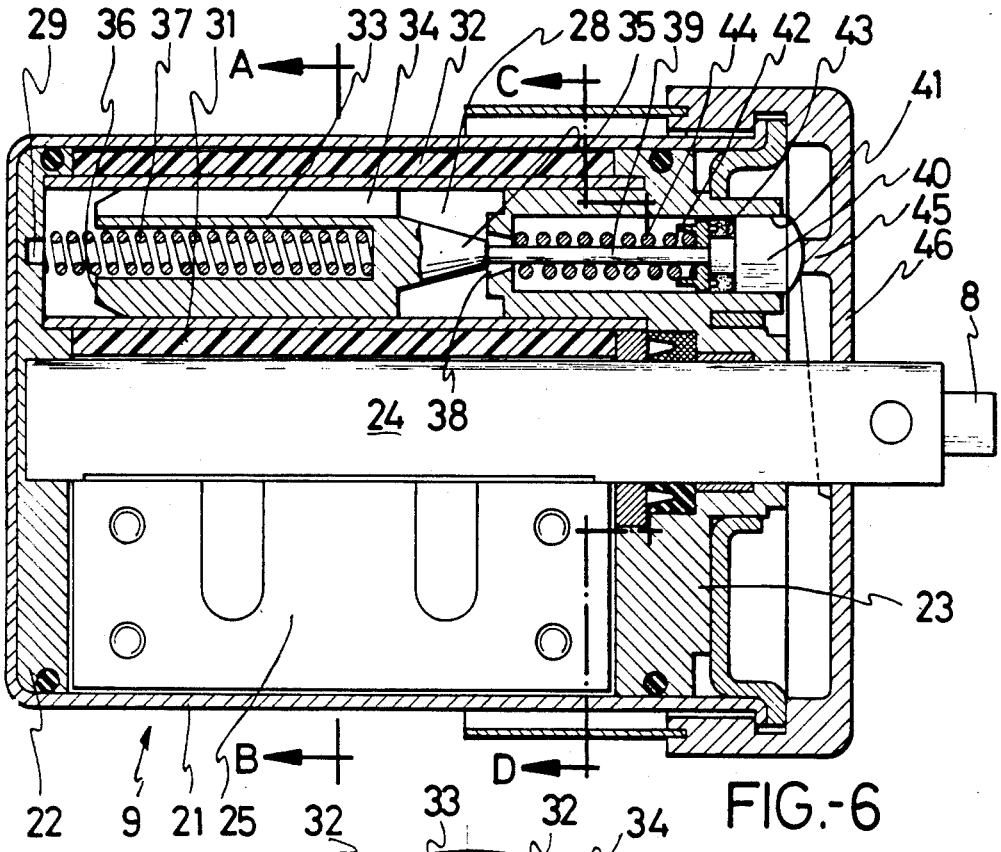
FIG. 6 is a longitudinal section of a preferred adjustable hydraulic brake of the machine of FIGS. 1 to 5.

In FIG. 4, a sub-assembly 15 is coupled to one end of frame 1 at its end corresponding to the footrest 14. A housing 17 provides a socket for a bar 16 of the sub-assembly.

The sub-assembly 15 uses the seat 6 itself as a stabilizing platform, the seat 6 being fixed to transverse bars 18 and 19 attached to the lower surface of bar 16. An actuating control 20 facilitates coupling and uncoupling of the bar 16 with respect to frame 1.

Referring now to FIGS. 6 through 9, the braking device includes a cylinder 21, sealed by end plates 22 and 23, and filled with a hydraulic fluid. The cylinder 21 coaxially supports a shaft 24 which extends to the exterior of cylinder 21 and provides a stub shaft 8 for supporting one of the actuating levers 12.

The shaft 24 has a radial blade 25 fixed thereto for rotation within the cylinder 21. Said radial blade 25 is provided with a one-way flap valve 26, of a conventional type, and a seal 27 engaged with the inner surface of cylinder 21.

Positioned between the shaft 24 and the inner surface of cylinder 21 is tubular chamber 28, the ends of which are received in the end plates 22 and 23. The end plates 22 and 23 have passages 29 and 30 which communicate the interior of the cylinder 21 with the interior of the tubular chamber 28, on opposite sides of the radial blade 25. Tubular chamber 28 is positioned within a casing 31 having longitudinal thickenings 32 which provide seals between the inner surface of the cylinder 21 and the outer surface of the shaft 24.

Within the tubular chamber 28 there is slidably mounted a body 33, provided with radial fins 34 designed to guide axial displacements of said body. The body 33 has a conical point 35 at one of its ends, its other end 36 being open and housing a spring 37.

Spring 37 pushes the body 33 towards a conical seat situated within the tubular chamber 28, and into engagement with an axially displaceable rod 39 carried by a cam follower 40 slidable within a bore 41 of end piece 23, and which is sealed by a seal 43.

A spring 44 reacts between seat 38 and a bushing 42 to bias the cam follower 40 into engagement with a ramp cam 45 provided on the inner face of a rotary cap 46, the cap 46 being adjustable angularly about the axis of cylinder 21.

Figure 7:
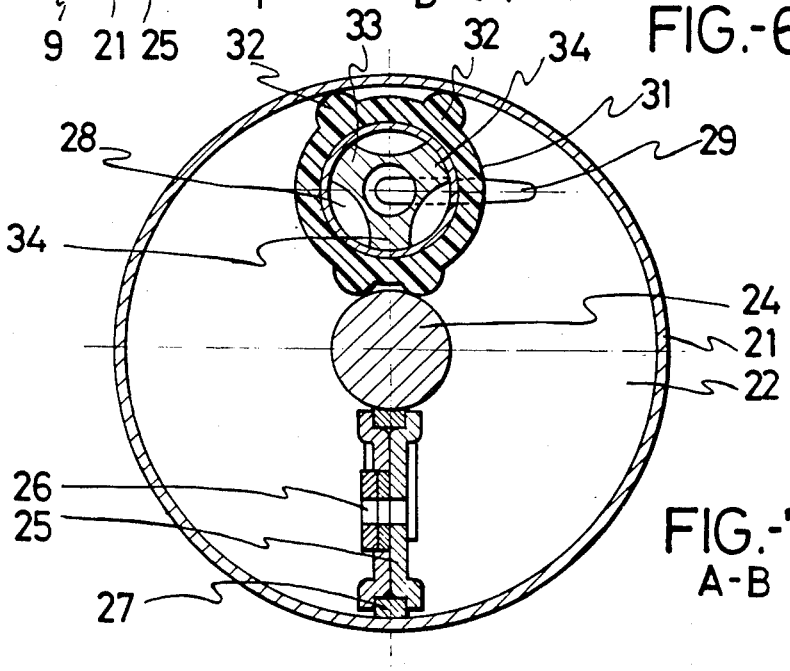
FIG. 7 is a diametral section taken on the line A—B of said FIG. 6.
Figure 8:
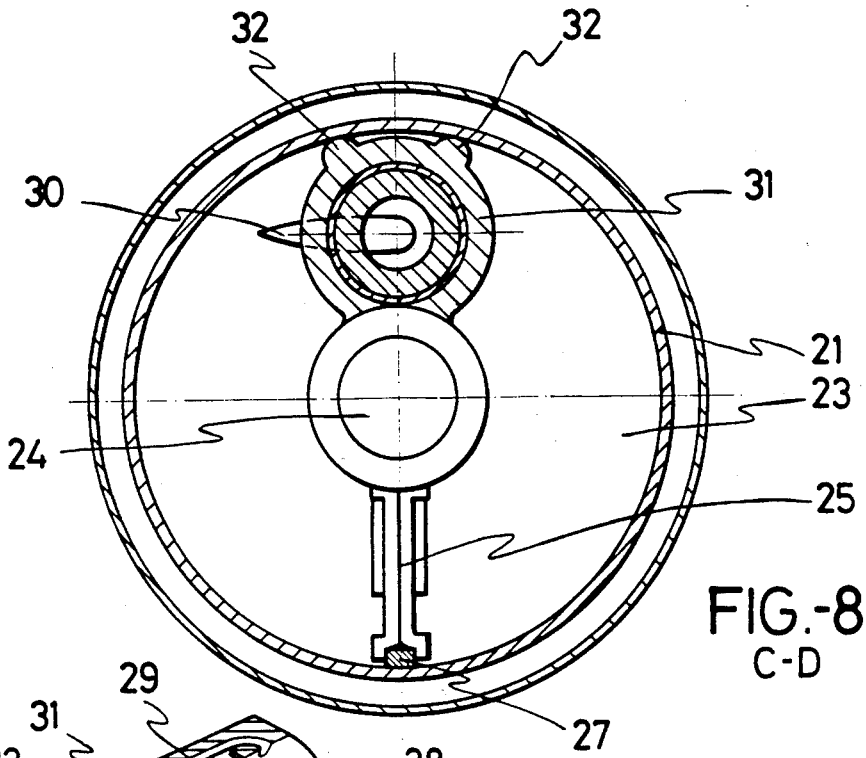
FIG. 8 is another diametral section taken on the line C—D of FIG. 6.
Figure 9:
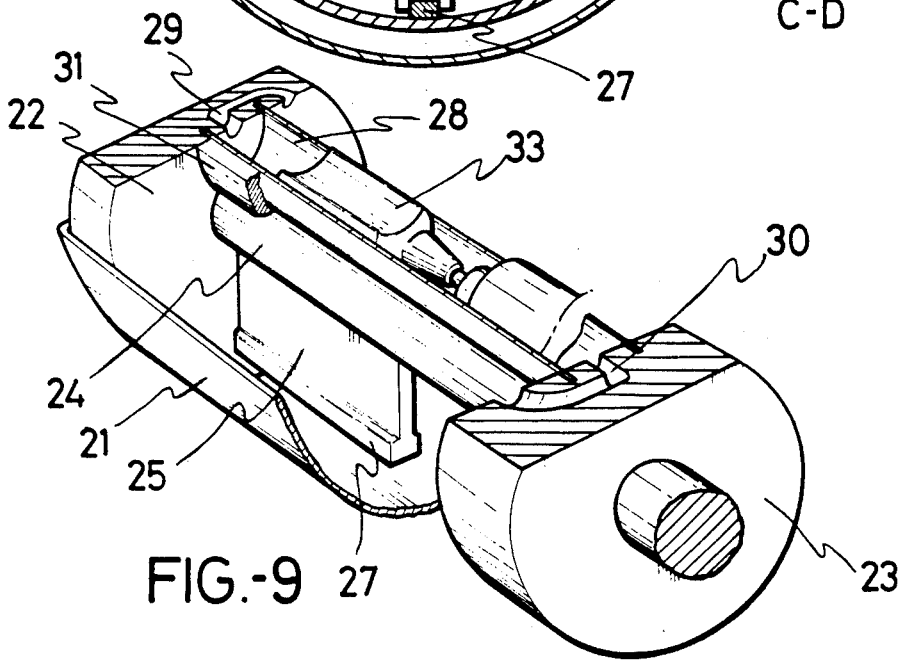
FIG. 9 is a schematic perspective view of the adjustable hydraulic brake device of FIGS. 6 to 8, showing a partial section thereof.

When the shaft 24 is rotated in a counter clockwise direction as shown in FIG. 7, the one-way valve 26 closes, and fluid contained in the cylinder 21 is compressed by the blade 25 and is forced to pass through a passage 29. The fluid then moves through chamber 34, and through the valve seat 38, which is open to an extend determined by the position of the member 35. The fluid then returns to the other end of cylinder 21 through the passage 30. This imposes a resistance to movement of the blade 25 and consequently to the oscillation of shaft 24. This resistance can be regulated by adjusting the conical point 35 relative to the seat 38, which is done by turning the cap 46 so that the ramp 45 adjusts the axial position of the cam follower 40 of the rod 39.

When the shaft oscillates in a direction opposite to that described, the one-way valve 26 opens permitting the fluid to pass directly from one side of the vane to the other, and offer less resistence to the blade 25 in its displacement in the inside of cylinder 21.

The brake mechanism described above permits the actuating levers to move independently by rotating the shafts 24 against a determined resistance, while the return of said levers to their starting position can be effected easily and with little effort.

As shown in FIG. 10, and to permit use of the exercise machine for other physical exercises, the bar 16 is of tubular form, and incorporates a pawl 47, rotatably mounted about a shaft 48 and provided with a latch 49 which emerges laterally of said tubular bar 16. The latch is received in the housing 17 of frame 1, said pawl 47 being baissed towards a locking position by a spring 50, likewise installed in the inside of the tubular bar 16.

Locking of said pawl 47 with respect to frame 1 is effected automatically by the spring 50. The pawl 47 can be unlocked by a control 20 located at the opposite end of the bar 16 and which is connected to the pawl 47 by a rod 51.

The seat 6 slides along frame 1, and becomes independent from said frame if and when required.

Figure 12:
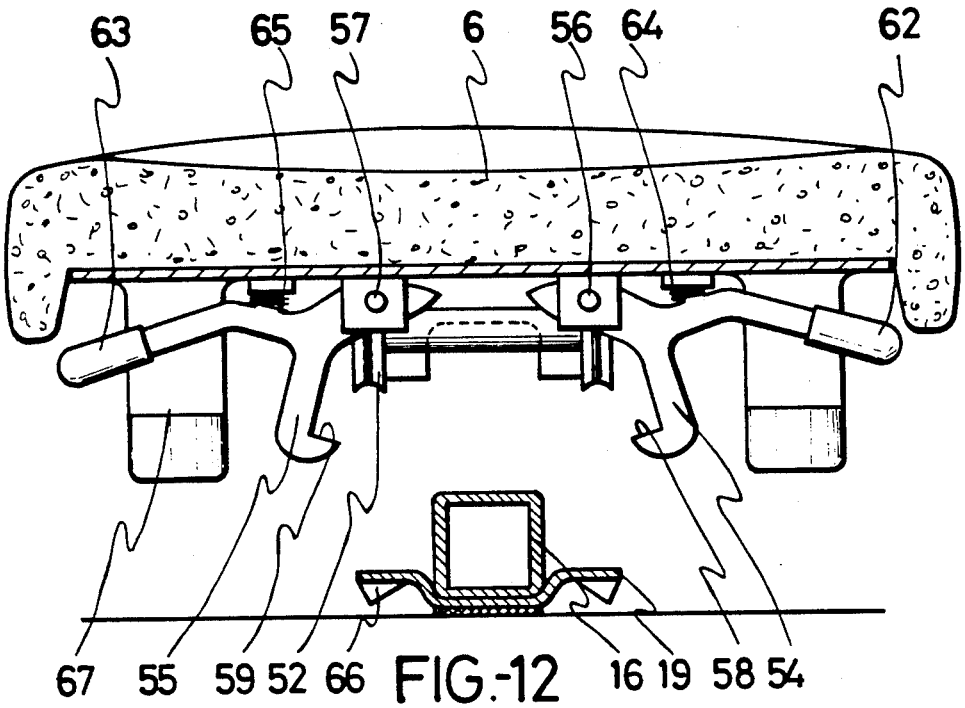
FIG. 12 shows the seat of FIG. 11, with its locking mechanisms set free and facing the accessory bar in positions to be coupled together.
Figure 13:
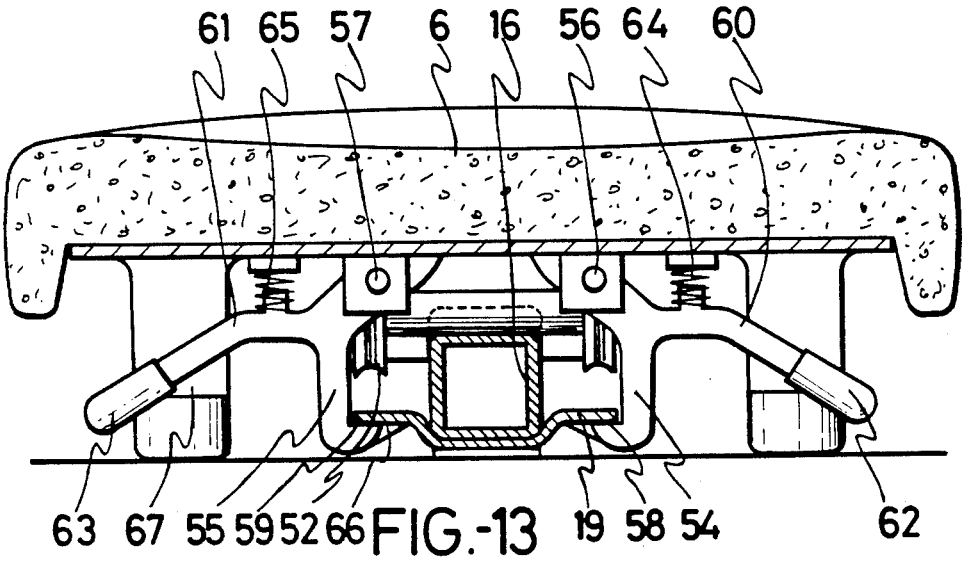
FIG. 13 shows the assembly of FIG. 12, duly coupled together.

To that effect, and as can be seen in FIGS. 11 to 13, the seat 6 incorporates rollers 52, designed to roll along guides 53 provided by the frame 1. Two pawls 54 and 55 are journalled on the body of the seat 6 itself at 56 and 57, and have latches 58 and 59 which act as retention elements for the seat with respect to the frame 1. The seat and the frame can be coupled together, as can be seen in FIG. 11 or, the seat can be coupled to the bar 16 of the accessory 15, as can be seen in FIG. 13.

The pawls 54–55 include arms 60–61 having handles 62–63 and are biassed by springs 64–65 which act to move the latches into locking position, either with the frame 1 or with the bar 16. In the latter case, the latches engage transverse bars 18 and 19 secured to said bar 16.

In order to ensure immobilization of said seat against longitudinal displacement relative to the bar 16, the transverse bars 18 and 19 include lugs 66 bent downwardly, as it is clearly illustrated in FIGS. 12 and 13, in a manner such that said lugs 66 will receive and locate the latches against dispacement axially of the bar 16.

The seat 6 is provided with legs 67, which, when said seat is coupled to the accessory 15 as can be seen in FIG. 13, engage the floor and confer to the assembly a suitable degree of stability.

The legs 67 of the seat cooperate with supports 68 provided on the footrest 14, clearly shown in FIG. 5 and which also appear in FIG. 4, for the purpose of providing stability to the exercise machine when in the latter position.

An articulated connection between the actuating levers 12 and the associated shafts 8 is shown in FIGS. 14 and 15. A fork 10 is secured to the end of the lever and is pivotally mounted on a pin 11 extending through the shaft 8. The shaft 8 extends externally through a slotted hole 69 in the fork, and provides lateral stops for the actuating levers 12. This structure permits the levers 12 to adopt one of two positions; a first position as shown in FIG. 2 in which the levers extend parallel to each other and parallel to the frame 1, and a second position in which the levers as shown in FIG. 1, form a divergent angle with respect to the intermediate frame 1. This enables the user to exercise with a greater or lesser distance between the handles 13 of said actuating levers.

Referring now to FIGS. 16 through 19 the footrest 14 includes slots 70 through which passes a flexible band 71 forming a bridge on the top of each of the inclined planes at opposite sides of the frame 1. The intermediate portion of the band 71 passes underneath the footrest 14 and passes through guides 72. Two bights 73 of the belt can be tightened by means of a fork 74 fast with a lever 75. A handle 76 is provided to make activation of the lever 75 easier. The lever 75 is journalled on a shaft 77 placed underneath frame 1, and emerges through a slot 78 in the frame 1 provided with a series of grooves 79 designed to selectively lock said lever in a selected one of a plurality of stable locking positions. Thus, a greater or lesser tightening of the band 71 can be provided.

By mounting the band 71 in a manner as shown in FIGS. 10 through 19, the user can easily adjust the tension of said band to his specific needs, in order to properly secure the feet to the footrest 14. The lever 75 can be easily reached in a normal position of use of the exercise machine, in which position the feet are supported by the footrest 14 and the body rests on the seat 6.

Figure 17:
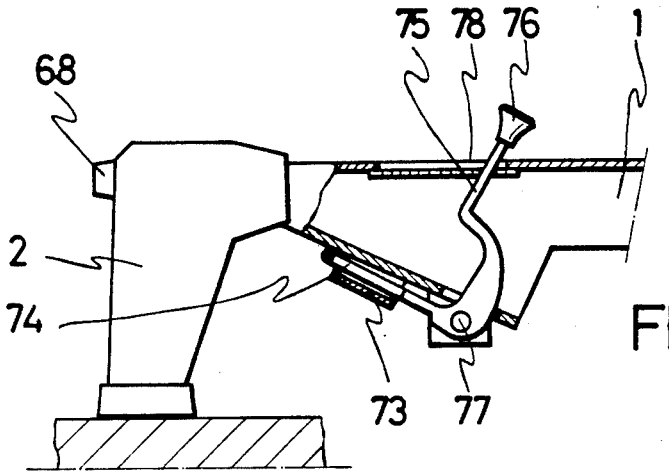
FIG. 17 is a partial sectional side elevational view of FIG. 16, showing a foot retaining band in a situation of minimum tension.
Figure 18:
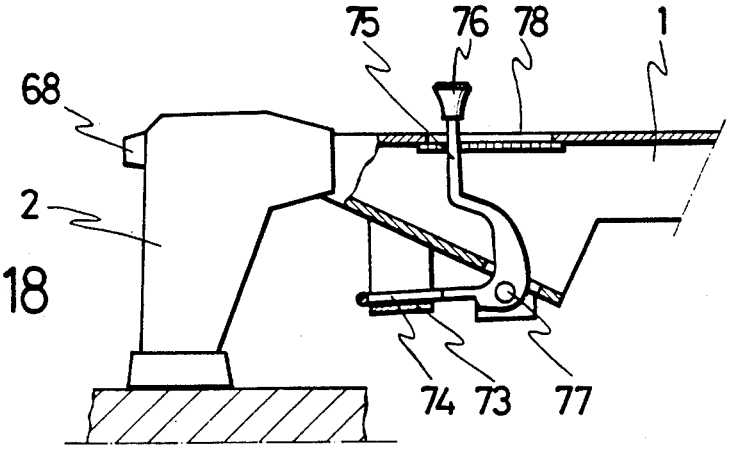
FIG. 18 shows, the foot retaining band of FIG. 17 in a situation of maximum tension.
Figure 19:
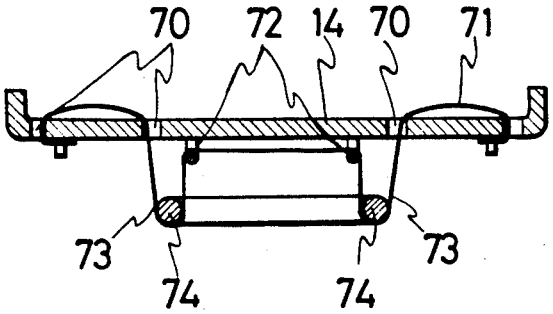
FIG. 19 is a transverse section taken along line E—F of FIG. 16.

The band 71 can be totally detensioned by movement of the lever 75 to the position shown in FIG. 17, to release the user's feet once an exercise has been completed.

Figure 20:
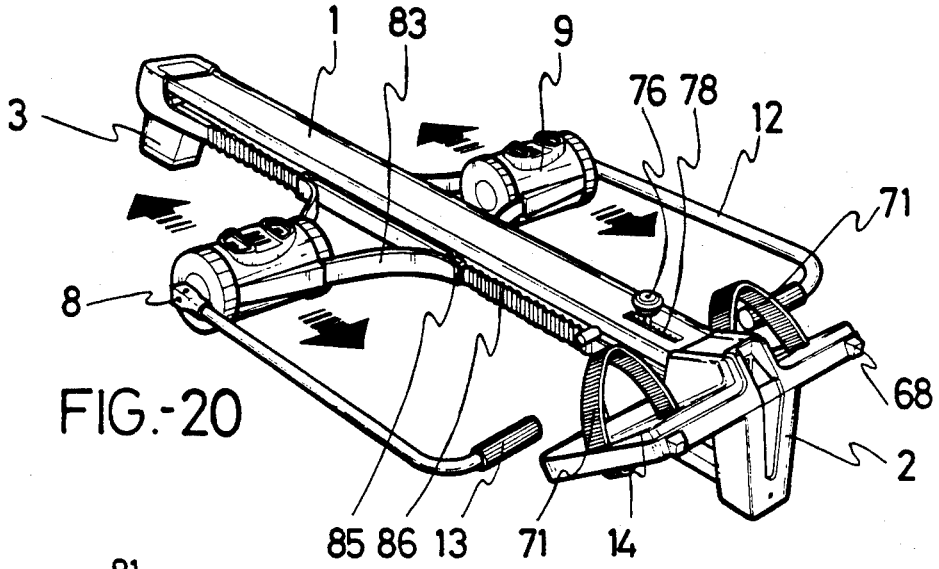
FIG. 20 is a perspective view of an alternative construction of the exercise machine, in which the actuating levers and their corresponding adjustable brake devices can be changed in position axially along the frame.
Figure 21:
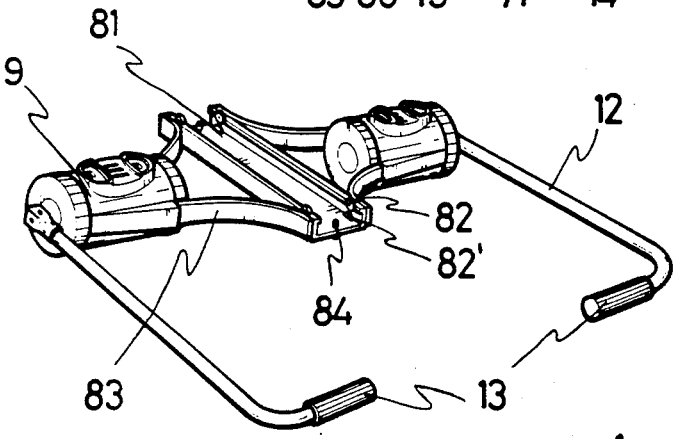
FIG. 21 shows a perspective view of the movable unit of the previous Figure, when removed from the frame.
Figure 22:
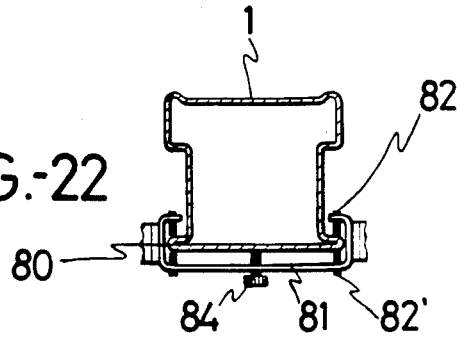
FIG. 22 is a sectional view through the movable unit and the frame.

A construction variant of the exercise machine is illustrated in FIGS. 20 through 22, which permits the user to control at will the distance between the actuating levers 12 and the footrest 14.

In this construction variant, frame 1 incorporates two longitudinal ribs 80 (FIG. 22) designed to permit a carrage 81 to be displaced longitudinally of the frame 1. The carriage has a U-shaped cross section with the lateral sides inwardly bent. Rollers 82 and 82' permit smooth displacement of the carriage 81. On both sides of said carriage 81 there are secured distance arm pieces 83 supporting brake mechanisms 9, of a type as described with reference to FIGS. 6 through 9.

In this manner, said brake mechanisms 9 and consequently the actuating levers 12 can be moved at will relative to the footrest 14, in accordance with the wishes or needs of each user.

In order to locate the carriage 81, once its position has been selected, setscrews 84 are provided on the carriage to lock the carriage to the frame 1.

Between the end zones 85 of the arms 83 and the end zones of frame 1, bellows 86 are provided to aesthetically finish off the lateral sides of the device. When the movable carriage slides, one of said bellows will compress while the other will extend.

Figure 23:
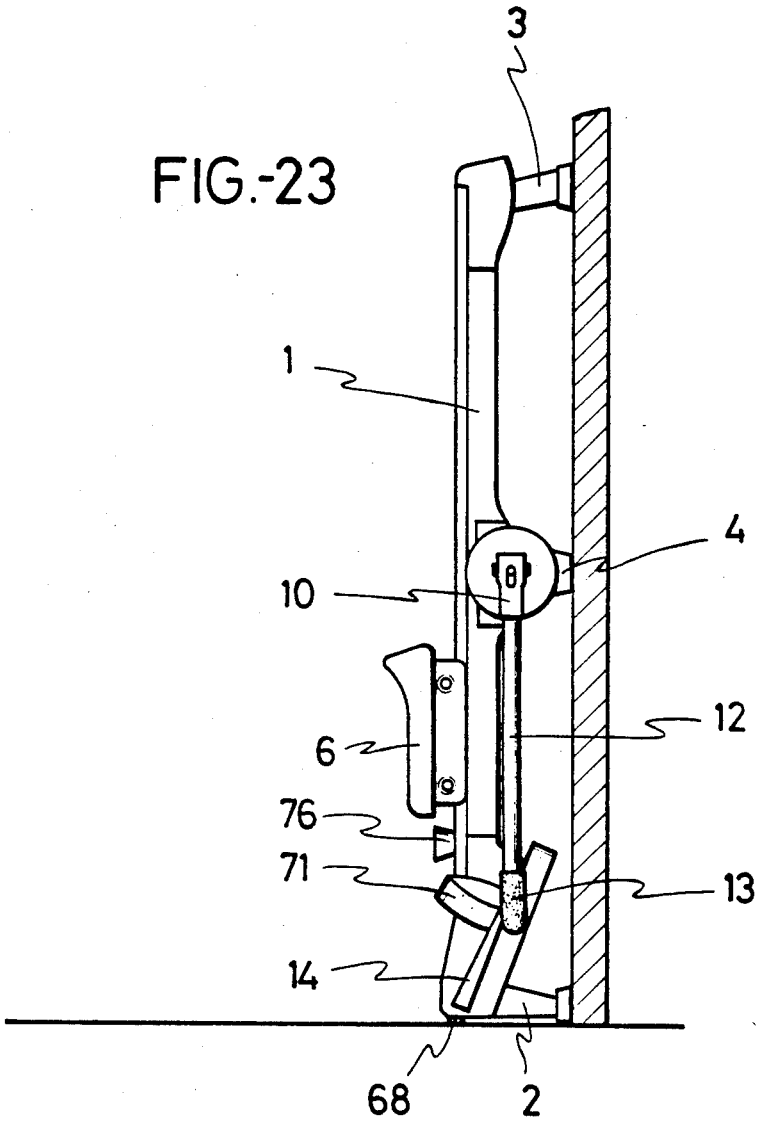
FIG. 23 shows the exercise machine when in a storage position.
Figure 24:
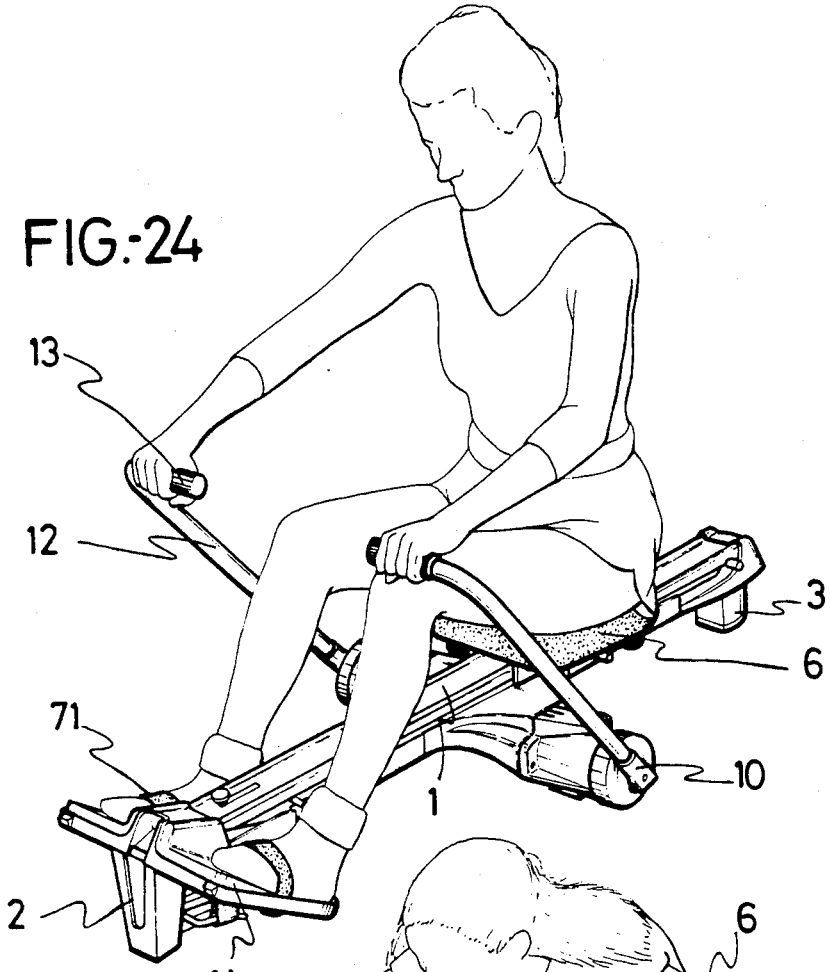
FIG. 24 shows a preferred embodiment of the exercise machine when in use.
Figure 25:
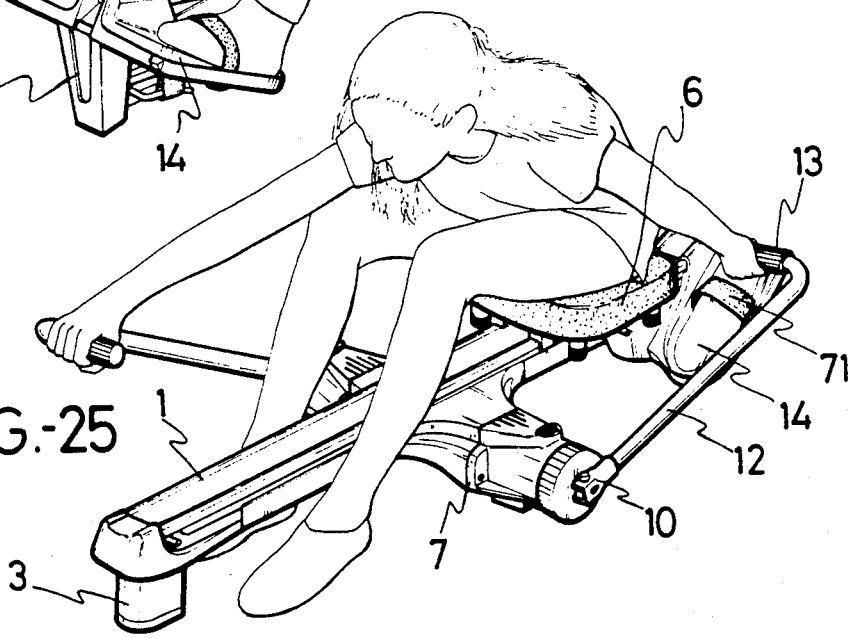
FIGS. 25, 26, 27, 28 and 29 show alternative exercises that can be performed using the exercise machine of the present invention.
Figure 26:
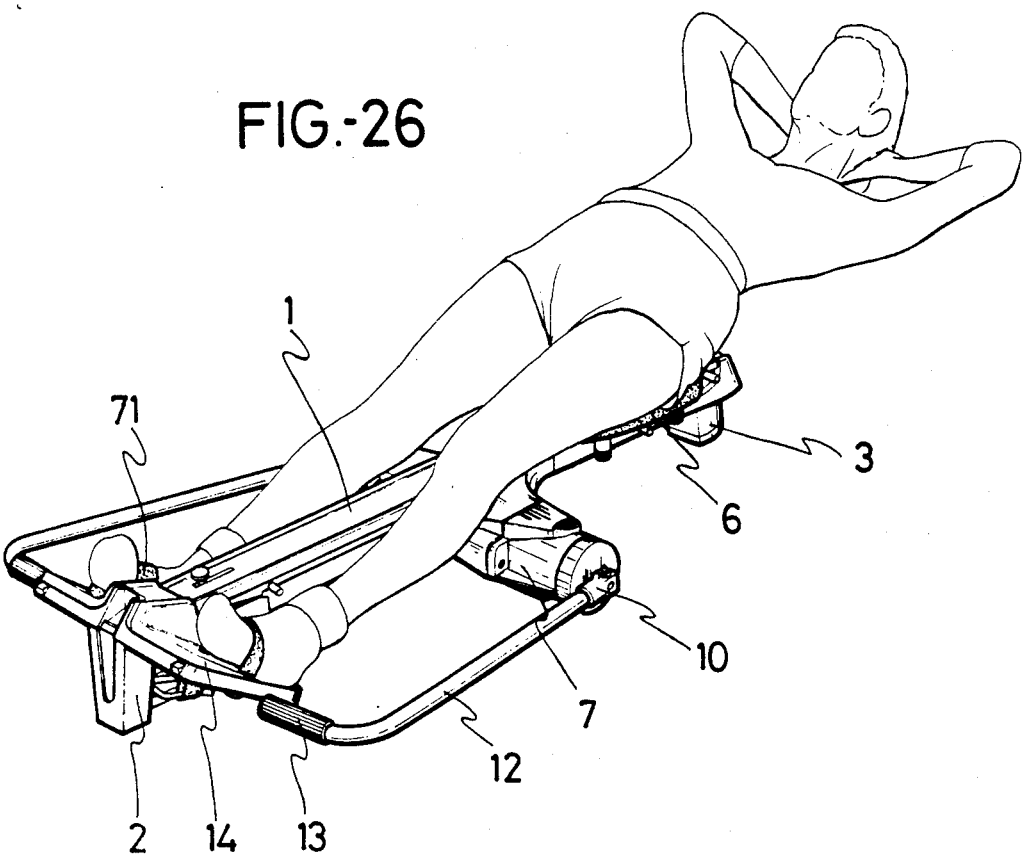
Figure 27:
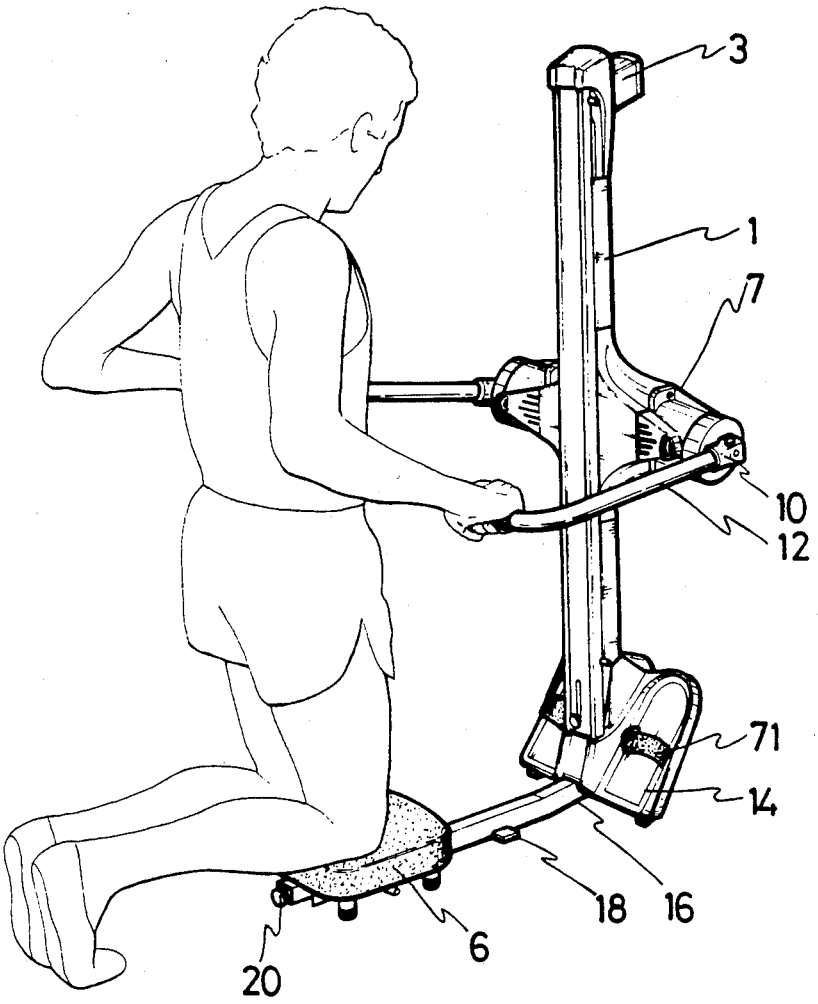
Figure 28:
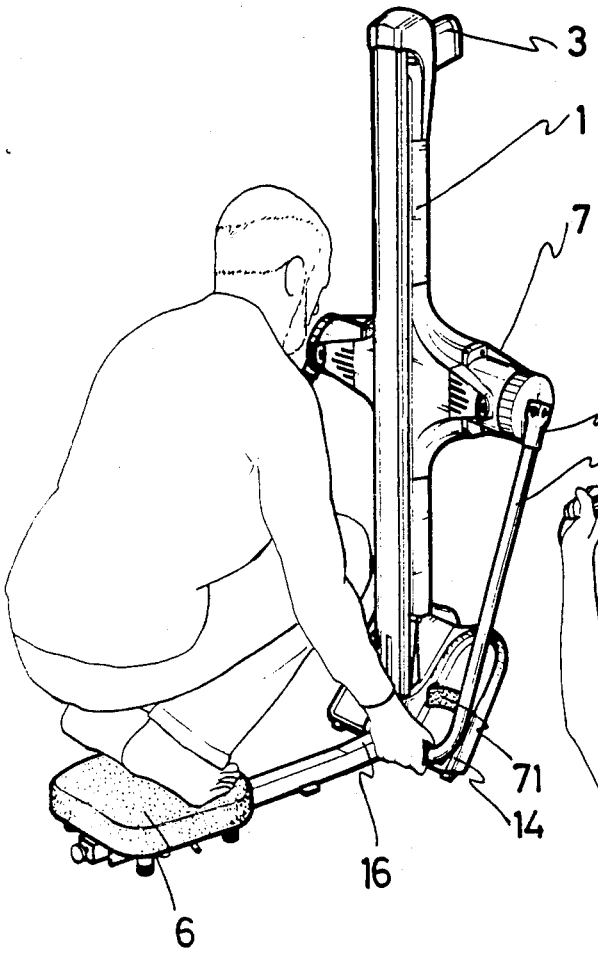
Figure 29:
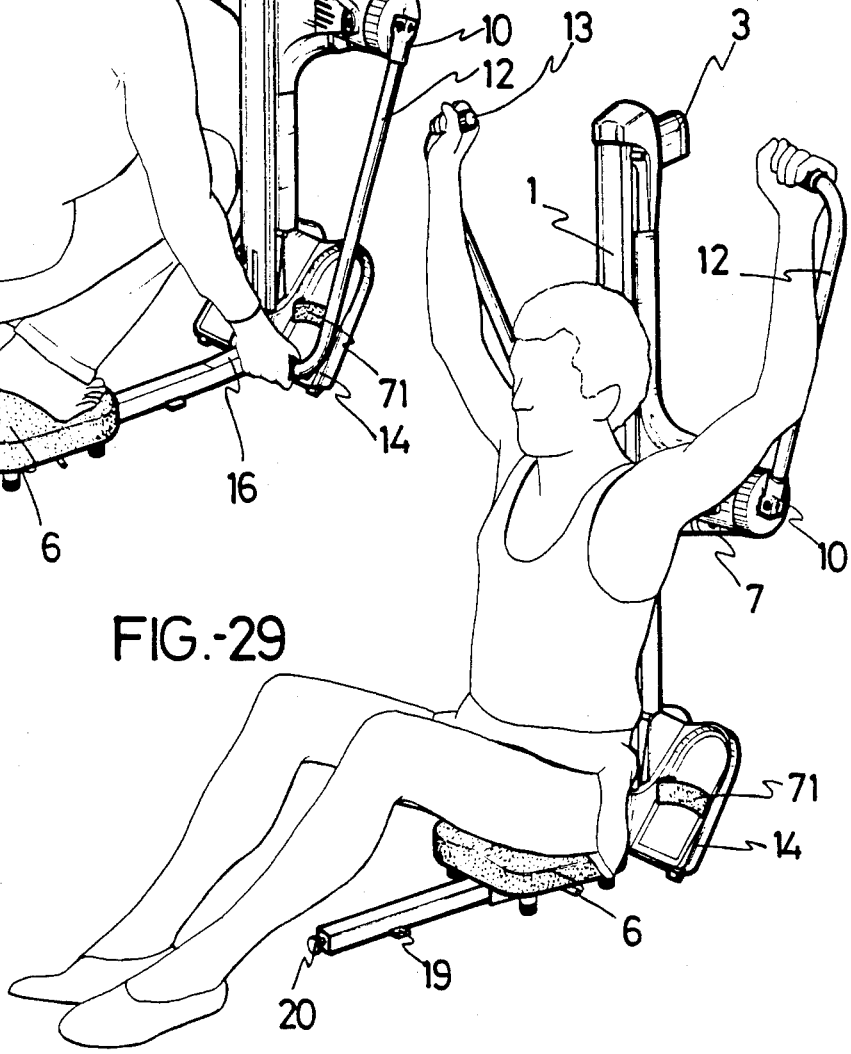

The exercise machine of the present invention provides a simple and compact structure which can be easily stored. In that condition, protuberances 68 on the footrest 14 rests on the floor and the supports 2, 3 and 4 of frame 1 rest against a wall, with the frame 1 in vertical disposition, as it is clearly illustrated in FIG. 23. The accessory 15 is but a simple bar and can easily be stored. Independent control of the braking resistance for each of the actuating levers is provided, as is the adjustment at will of the distance between the levers and the footrest. The strap employed to secure the users feet to the footrest can be adjusted to the user's needs. This is accompanied by the possibilty of performing any one of a multiplicity of different physical exercises on the exercise device, as it is clearly illustrated in FIGS. 24 through 29, which only show some of the many possibilities while evidencing the great versatility of the device.

It is not considered necessary to enlarge upon the present description to enable a skilled person to fully understand the scope of the invention and the advantages derived therefrom.

The materials, shape, size and disposition of the parts or elements may be modified, within the scope of the appended claims.

I claim:

1. A protable exercise machine including:

an elongate frame:

a foot rest rigidly connected to one end of said frame;

a seat slidable longitudinally along said frame;

energy absorber means rigidly supported by said frame at a position intermediate said seat and said foot rest;

levers positioned on each lateral side of said frame and respectively connected to said energy absorber means;

said energy absorber means comprising:

a closed cylinder rigidly supported on said frame with a longitudinal axis of said cylinder extending transverse to the longitudinal axis of said frame;

a vane rotatable within said cylinder about an axis coaxial with said longitudinal axis of said cylinder, and providing a stub shaft extending exteriorly of said cylinder through an end wall of said cylinder;

partition wall means positioned internally of said cylinder and extending radially thereof, said partition wall means providing a closed chamber at each opposite side of said vane;

a one-way valve means interconnecting one of said closed chambers with the other of said closed chambers;

adjustable bleed valve means interconnecting said closed chambers;

said adjustable bleed valve means being located within said partition wall means, and including a valve seat and a valve member cooperating with said valve seat, said valve member being movable against a spring bias by a push rod extending through said end wall, further including a ramp cam rotatable about the axis of said cylinder and cooperating with said push rod to move said push rod axially upon rotation of said ramp cam about said cylinder axis; and, journal means connecting said levers to said stub shaft for angular movement in a plane including the axis of said stub shaft and for movement about the axis of said stub shaft in unison with movement of said vane and said stub shaft within said cylinder.

2. A portable exercise machine including:

an elongate frame;

a foot rest rigidly connected to one end of said frame;

a seat slidable longitudinally along said frame;

energy absorber means rigidly supported by said frame at a position intermediate said seat and said foot rest;

a first carriage supporting said seat for movement longitudinally of said frame, a second carriage supporting said energy absorber means for movement longitudinally of said frame, and means for securing said secondary carriage in a selected position of adjustment; and levers positioned on each lateral side of said frame and respectively connected to said energy absorber means;

said energy absorber means comprising:

a closed cylinder rigidly supported on said frame with a longitudinal axis of said cylinder extending transverse to the longitudinal axis of said frame;

a vane rotatable within said cylinder about an axis coaxial with said longitudinal axis of said cylinder, and providing a stub shaft extending exteriorly of said cylinder through an end wall of said cylinder;

partition wall means positioned internally of said cylinder and extending radially thereof, said partition wall means providing a closed chamber at each opposite side of said vane;

a one-way valve means interconnecting one of said closed chambers with the other of said closed chambers;

adjustable bleed valve means interconnecting said closed chambers; and, journal means connecting said levers to said stub shaft for angular movement in a plane including the axis of said stub shaft and for movement about the axis of said stub shaft in unison with movement of said vane and said stub shaft within said cylinder.

3. A portable exercise machine including:

an elongate frame;

a foot rest rigidly connected to one end of said frame;

a seat slidable longitudinally along said frame;

socket means incorporated into said foot rest, a detachable support bar insertable into said socket means and securable therein in substantially perpendicular relationship with said frame, means carried by said seat for detachably attaching said seat to said support bar, and feet on an underside of said seat for engagement with a floor when said seat is attached to said support bar and said support bar is secured in said socket means to support said machine when moved from a prone position to an upright position, said foot rest also including feet for engagement with said floor to further stabilize said machine when moved from said prone to said upright position;

energy absorber means rigidly supported by said frame at a position intermediate said seat and said foot rest;

levers positioned on each lateral side of said frame and respectively connected to said energy absorber means;

said energy absorber means comprising:

a closed cylinder rigidly supported on said frame with a longitudinal axis of said cylinder extending transverse to the longitudinal axis of said frame;

a vane rotatable within said cylinder about an axis coaxial with said longitudinal axis of said cylinder, and providing a stub shaft extending exteriorly of said cylinder through an end wall of said cylinder;

partition wall means positioned internally of said cylinder and extending radially thereof, said partition wall means providing a closed chamber at each opposite side of said vane;

a one-way valve means interconnecting one of said closed chambers with the other of said closed chambers;

adjustable bleed valve means interconnecting said closed chambers; and journal means connecting said levers to said stub shaft for angular movement in a plane including the axis of said stub shaft and for movement about the axis of said stub shaft in unison with movement of said vane and said stub shaft within said cylinder.

4. A portable exercise machine including:

an elongate frame;

a foot rest rigidly connected to one end of said frame;

said foot rest including strap means for engagement with the feet of the user, fork means pivotally mounted on an underside of said foot rest, and means for adjusting and securing said fork means in a selected position of adjustment, said fork means engaging bights of said strap means and acting to draw said strap means into engagement with the feet of said user;

a seat slidable longitudinally along said frame;

energy absorber means rigidly supported by said frame at a position intermediate said seat and said foot rest;

levers positioned on each lateral side of said frame and respectively connected to said energy absorber means;

said energy absorber means comprising:

a closed cylinder rigidly supported on said frame with a longitudinal axis of said cylinder extending transverse to the longitudinal axis of said frame;

a vane rotatable within said cylinder about an axis coaxial with said longitudinal axis of said cylinder, and providing a stub shaft extending exteriorly of said cylinder through an end wall of said cylinder;

partition wall means positioned internally of said cylinder and extending radially thereof, said partition wall means providing a closed chamber at each opposite side of said vane;

a one-way valve means interconnecting one of said closed chambers with the other of said closed chambers;

adjustable bleed valve means interconnecting said closed chambers; and journal means connecting said levers to said stub shaft for angular movement in a plane including the axis of said stub shaft and for movement about the axis of said stub shaft in unison with movement of said vane and said stub shaft within said cylinder.

* * * * *